US005540334A

United States Patent [19]

Haas et al.

[11] Patent Number: 5,540,334

[45] Date of Patent: Jul. 30, 1996

[54] BEAKER TRANSPORT TRAY

[75] Inventors: Leonard Haas, Rochester, N.Y.; Lori J. Barger, Arlington, Wis.

[73] Assignee: Lab Safety Supply, Inc., Janesville, Wis.

[21] Appl. No.: 293,789

[22] Filed: Aug. 22, 1994

[51] Int. Cl.[6] ..... B65D 1/34; B65D 6/04

[52] U.S. Cl. ..... 206/563; 206/562; 206/446; 422/104

[58] Field of Search ..... 206/562, 563, 206/564, 427, 433, 446, 386; 211/74, 75; 422/102, 104

[56] References Cited

U.S. PATENT DOCUMENTS

| | | | |
|---|---|---|---|
| 938,675 | 11/1909 | Lorenz . | |
| 1,677,276 | 7/1928 | Deicken . | |
| 1,926,481 | 9/1933 | Fox | 65/53 |
| 2,880,865 | 4/1959 | Knox | 206/72 |
| 3,025,948 | 3/1962 | Appelt | 206/563 |
| 3,351,210 | 11/1967 | Murcott | 211/74 |
| 3,501,044 | 3/1970 | Stone | 220/234 |
| 3,643,812 | 2/1972 | Mander et al. | 206/446 |
| 3,807,954 | 4/1974 | McDonald | 206/563 |
| 3,944,109 | 3/1976 | Holz | 220/20 |
| 4,394,905 | 7/1983 | Hackenberg | 206/486 |
| 4,448,312 | 5/1984 | Schuman | 211/49 |
| 4,567,981 | 2/1986 | Headon | 206/45.14 |
| 4,911,300 | 3/1990 | Colonna | 206/427 |
| 4,947,991 | 8/1990 | Snell | 206/427 |
| 5,080,232 | 1/1992 | Leoncavallo et al. | 206/446 |
| 5,135,787 | 8/1992 | Bair | 428/36.1 |

*Primary Examiner*—Paul T. Sewell
*Assistant Examiner*—Tara Laster
*Attorney, Agent, or Firm*—Keck, Mahin & Cate

[57] ABSTRACT

A carrier (8) is provided with one permanent tray member (30) and several tray inserts (40) and (41) that will hold vessels of different dimensions. The tray inserts (40) and (41) are placed on top of the permanent tray (30) and stay in place without movement. The carrier (8) has a solid bottom panel (10) with rigid sidewalls (20) that can be sterilized by gas, radiation, or cleaned with disinfectant. The carrier (8) can transport ice for cooling samples and/or an absorbent material for absorbing spills. The permanent tray (30) and tray inserts (40) and (41) preferably have a perforated hole design (37) throughout to conduct any spills quickly away from the user toward the bottom panel (10) of the carrier (8).

12 Claims, 2 Drawing Sheets

BEAKER TRANSPORT TRAY

TECHNICAL FIELD OF THE INVENTION

This invention relates in general to fluid transport and safety apparatus, and more particularly to a tray for the transport of fluid vessels of different sizes.

BACKGROUND OF THE INVENTION

In a laboratory or production setting, personnel often have to transport glassware containing hazardous substances from one location to another. It is in the best interest of management to provide users with the safest equipment possible. Safety equipment suppliers sell a limited offering of laboratory trays for moving glassware and other types of vessels.

Conventional trays have several limitations. Some of the trays lack sidewalls, making it likely that if the tray is jostled, its contents will fall off. Another limitation of this type of tray is that it contains an inadequate mechanism for containing a spill should one occur. Third, use of flat trays does not prevent pieces of glassware from knocking against each other which could lead to breakage and spills.

There are utility lab trays that have sidewalls which would prevent a piece of glassware or other container from toppling over the edge of the tray. While such trays are able to contain a spill, they are not capable of preventing pieces of glassware from moving within the tray and knocking into each other.

Test tube racks are another example of devices that could be used for transporting and storing glassware; however, they have limitations too. Racks are limited to holding glassware of a single size, or of a rigid selection of sizes. This limitation requires the user to purchase multiple racks of various sizes to accomodate each size of glassware in use.

U.S. Pat. No. 2,880,865 issued to Knox discloses a hematological tray for the collection of blood samples. The hematological tray has slots for holding glassware of different sizes; however, it does not allow flexibility in the sizes of items it accomodates.

SUMMARY OF THE INVENTION

The invention encompasses an apparatus for transporting fluid vessels comprised of a bottom panel with a plurality of upstanding sidewalls joined to the periphery to form a cavity. A permanent tray is affixed to the sidewalls inside the cavity. The permanent tray has at least one first opening to hold a vessel of a predetermined size. The carrier of the invention also encompasses at least one, and preferably more, removable tray inserts which can be placed on top of the permanent tray. The removable tray insert has at least one second opening, smaller than the first opening, which is in registry with the first opening when the insert is placed on top of the permanent tray. The second openings of the removable tray inserts can be of various sizes to accomodate different vessel sizes. A vessel to be transported, such as a beaker, is placed within the cavity of the apparatus in such a way that it is secured within the opening formed by the removable tray insert and the permanent tray. In a preferred embodiment, the carrier of the invention may be adapted to carry a variable number of up to three sizes of vessels.

The present invention is an improvement over the safety equipment currently offered. The present invention has sidewalls to maintain the lateral stability of the glassware, and individual wells or holes that are adaptable to different sizes of glassware, preventing the laboratory glassware from knocking into each other. The present invention is adaptable to carry different sizes of glassware at the same time in different configurations, such that multiple units are not necessary. Also, the permanent tray and tray insert of the present invention preferably have a perforated structure to channel spilled fluids toward the bottom of the tray.

BRIEF DESCRIPTION OF THE DRAWINGS

Further aspects of the invention and its advantages may be understood from the following detailed description when read with reference to the drawings, in which like characters denote like parts, and in which.

DETAILED DESCRIPTION OF THE INVENTION

Figure 1:
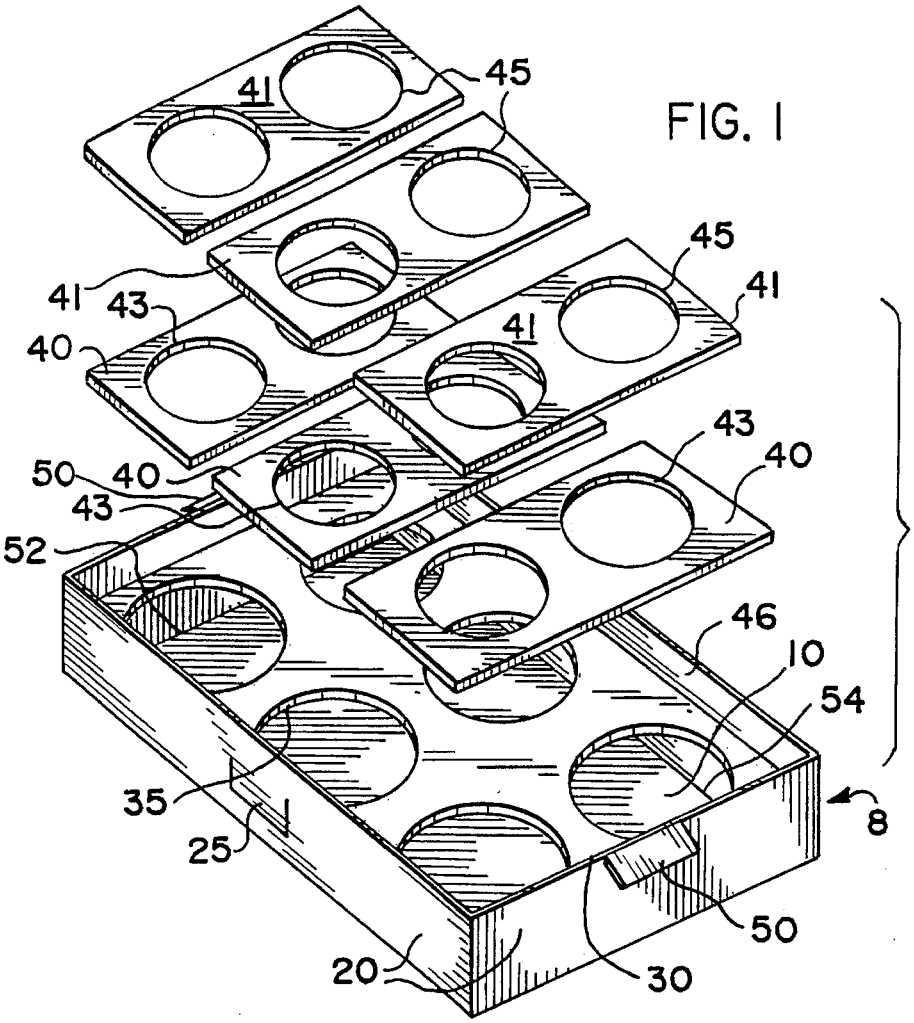
FIG. 1 shows an exploded isometric view of an assembled carrier according to the invention.

Referring to FIG. 1, the outer structure of a carrier indicated generally at 8 consists of a bottom panel 10 and sidewalls 20. The sidewalls 20 are attached to the bottom panel 10 by heat bonding (welding). Together, the bottom panel 10 and the sidewalls 20 form a rectangular tray having predetermined depth.

A permanent tray member 30 is affixed to the inside face of the sidewalls 20 so as to be recessed below the top edge of the sidewalls 20. The permanent tray 30 can be affixed to the sidewalls 20 at any distance above the bottom panel 10 necessary to accomodate vessel depth. In the illustrated embodiment, the permanent tray 30 has six first openings 35. The diameter of the first openings 35 is selected to be slightly greater than the diameter of the largest size vessel that the carrier 8 is contemplated to carry. The permanent tray member 30 is composed of a sheet having a perforated structure 37 throughout for channeling spilled fluids toward the bottom panel 10 of the carrier 8.

Six removable tray inserts 40 and 41 are depicted in FIG. 1. Each removable tray insert 40 has at least one (and preferably two) second openings 43 of a middle size which is smaller than openings 35. Each removable tray 41 has at least one (and preferably two) second openings 45 of a small size that is smaller than openings 43. The removable tray inserts 40 and 41 are sized to fit over the permanent tray 30 and interiorly of a lip or margin portion 46 of sidewalls 20 which upwardly extends from the permanent tray 30; the lip 46 acts to contain the inserts 40 and 41. When one insert 40 or 41 is placed on the permanent tray 30, it is closely received and unable to move in a width-wise direction; the longer opposed sidewalls prevent such movement. When three of the removable tray inserts 40 and/or 41 are placed on top of respective portions of the permanent tray 30, the permanent tray 30 is completely covered and the removable tray inserts 40 and/or 41 cannot move in either a lengthwise or a widthwise direction. Two second openings 43 of a middle size are in registry with two first openings 35 when any one removable tray insert 40 is placed on top of the permanent tray 30. From one to three tray inserts 41 may be used in the place of or in addition to tray inserts 40; in this way, from zero to six large holes or openings 35 may be masked with any combination of zero to three inserts 40 and zero to three inserts 41 to create a tray to hold varying sizes of fluid vessels, with holes 35 accomodating large sized vessels, holes 43 accomodating medium-sized vessels and holes 45 accomodating small-sized vessels. Like permanent tray 30, inserts 40 and 41 are preferably constructed of a perforated sheet material 37; all components are preferably fabricated of plastic.

Attached as by heat-bonding (welding) to opposing ones of sidewalls 20 are two handles 50 for grasping the carrier. On the outside face of a selected sidewall 20 may be placed a label holder 25 so that the vessels in a carrier 8 can be identified.

Figure 2:
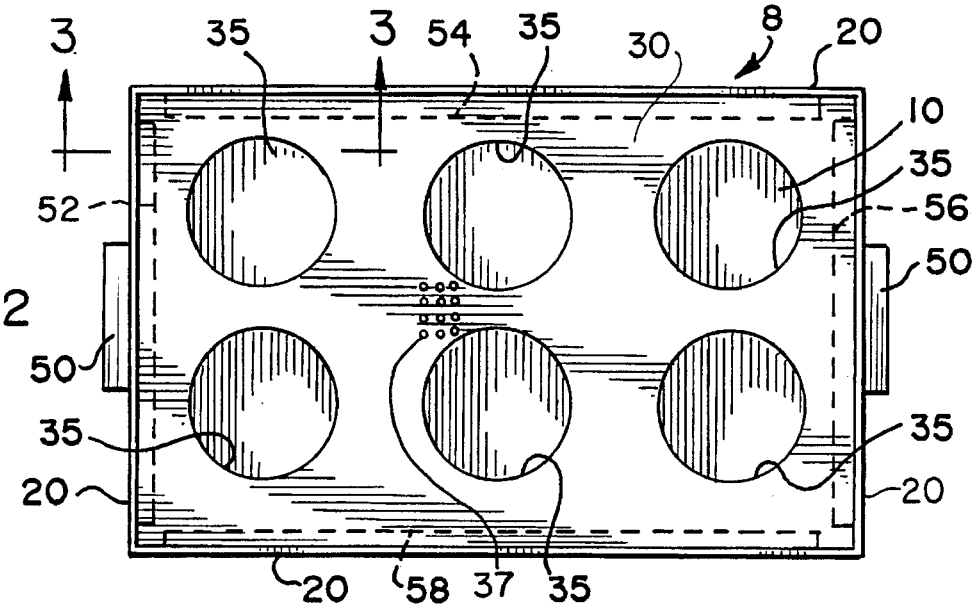
FIG. 2 shows a plan view of the carrier of FIG. 1 with only the permanent tray.

FIG. 2 illustrates a plan view of the carrier 8 with only the permanent tray 30. The permanent tray 30 is affixed at its edges to the sidewalls 20 at a predetermined distance above the bottom panel 10.

Figure 3:
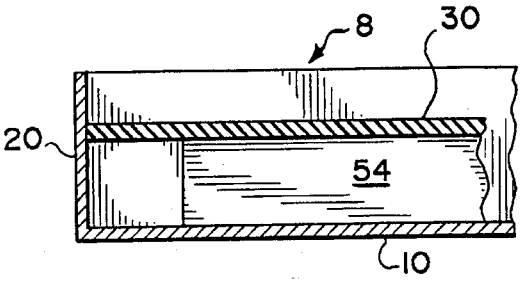
FIG. 3 is an elevational sectional view taken substantially along line III—III of FIG. 2.

The permanent tray 30 is structurally supported on each of its four sides by respective panels 52, 54, 56 and 58, shown in phantom in FIG. 2. Portions of panels 52 and 54 are visible in FIG. 1, and an elevational view of a portion of panel 54 is shown in the sectional view of FIG. 3. Panels 52, 54, 56 and 58 have a predetermined thickness such that when they are affixed on the inside of walls 20, they support the weight of permanent tray 30, to which they may be glued. The lengths of panels 52–58 are chosen to be less than the lengths of the sidewalls to which they are attached to avoid fitting tolerance problems. The heights of panels 52–58 are uniform and create a physical stop for the tray 30.

Figure 4A:
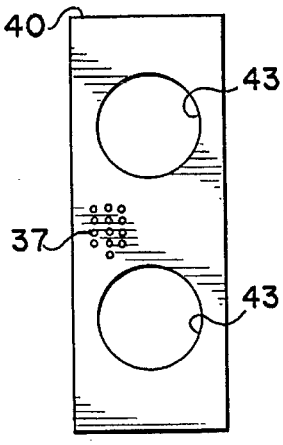
FIG. 4*a* shows a plan view of a first insert panel.
Figure 4B:
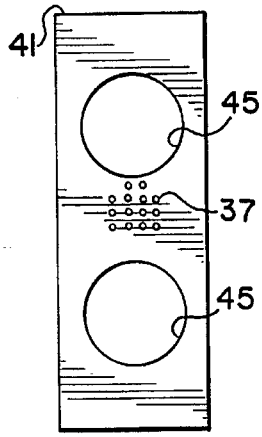
FIG. 4*b* shows a plan view of a second insert panel.

FIGS. 4*a* and 4*b* illustrate plan views of two removable tray inserts 40 and 41, respectively. The openings 43 and 45 are positioned so as to be centered on a respective pair of the openings 35 once an insert 40 or 41 is placed on the permanent tray 30; the rectangular nature of the tray inserts and the way in which they are closely received inside the upper limits of the sidewalls 20 automatically performs this centering. In a preferred embodiment, the centers of openings 43 and 45 on their respective tray inserts 40 and 41 are such that a maximum separation between held vessels will be obtained when selected ones of the inserts 40 and 41 are used in conjunction with permanent tray 30.

Holes 35 and holes 43 and 45 are illustrated to be circular in shape. Other openings can be used in masking off the large holes 35, such as ones of square, triangular, hexagonal, octagonal, elliptical or irregular shape. Furthermore, in place of each or of any one hole 43 or 45, a plurality of holes may be formed in a tray insert, all of which would be in registry with a single hole 35. For example, a plurality of small test tube holes may be formed in one of the tray inserts to be in registry with one or both of the large holes 35 in any particular transverse pair of holes 35. Still further, tray inserts may be devised that have differently sized holes in them or holes of different shapes. While the carrier system which has been illustrated has two sets of tray inserts 40 and 41, with three inserts apiece in each set, a tray carrier system could be provided with further sets of different inserts and/or different numbers of inserts in each set.

Figure 5:
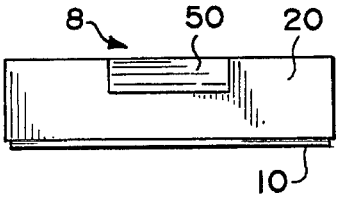
FIG. 5 shows a side view of the carrier.
Figure 6:
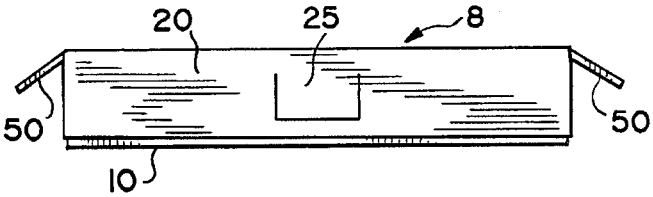
FIG. 6 shows a front view of the carrier of FIG. 5.

FIG. 5 illustrates a side view of the carrier 8, and FIG. 6 illustrates a front view of the carrier 8.

Figure 7:
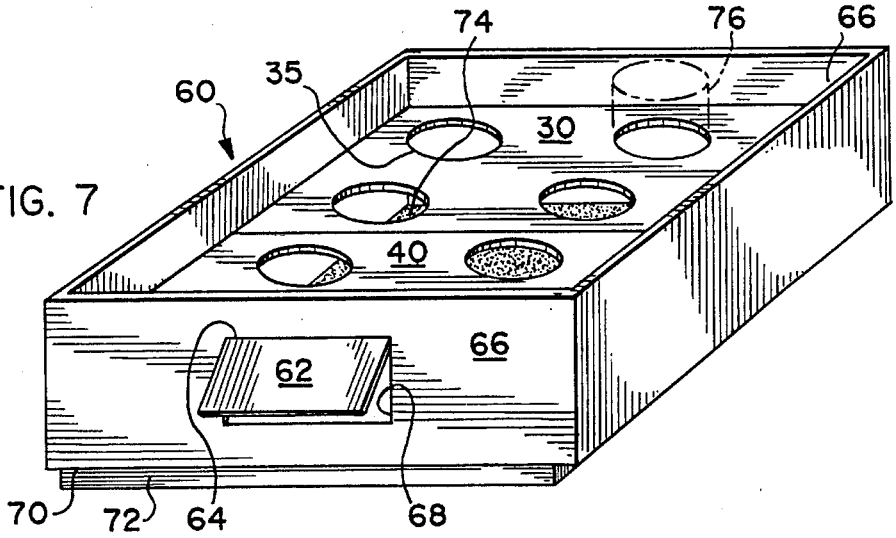
FIG. 7 is an exploded isometric view of an alternative embodiment of the invention.

FIG. 7 illustrates an alternative embodiment in which a carrier indicated generally at 60 has retractable handles 62 (one shown) which are hinged at their top margins 64 to opposed upstanding sidewalls 66. The handles 62 may be pulled out for carrying the tray 60, and may be pushed in to lay flush inside respective shallow cavities 68 (one shown) when not in use. The sidewalls 66 have a lower margin 70 that joins an indentation. A horizontal surface (not shown) extends inward from sidewall 66. An extension 72 of the sidewall 66 is joined to this horizontal surface and continues downwardly at a position which is horizontally interior to the main portion of the sidewall 66; this is repeated on all sides. This then creates an indentation for nesting multiple ones of the carriers 60 together, one on top of the other.

The embodiment shown in FIG. 7 also features a sheet 74 of absorbent material which has been inserted through one of the holes 35. The absorbent material is used as a fluid sump for spills from a fluid vessel 76 (shown in phantom) of what might be caustic or hazardous fluid material. In the place of sheet 74, ice (for cooling the fluid samples) may be used instead or in addition.

In summary, a fluid vessel carrier tray has been shown and described which allows the user to select any of several sized holes for receiving various fluid vessels, such as beakers, flasks and the like. While preferred embodiments of the invention have been described in conjunction with the above detailed description and the appended drawings, the invention is not limited thereto but only by the scope and spirit of the appended claims.

What is claimed is:

1. Apparatus for transporting a plurality of fluid vessels, comprising:

a bottom panel having a peripheral margin;

a plurality of upstanding sidewalls joined to said peripheral margin and extending upwardly therefrom;

a permanent tray member affixed to said sidewalls at a predetermined distance from said bottom panel, said permanent tray member having a plurality of spaced-apart first holes therein of a first size for receipt of fluid vessels of said first size;

at least one first insert, said first insert dimensioned to closely fit within opposed ones of said sidewalls, said first insert being provided with at least one second hole having a second size smaller than said first size, said first insert capable of being placed on said permanent tray member such that said second hole is in registry with one of said first holes while said first insert is fit between opposed ones of said sidewalls; and at least one second insert, said second insert dimensioned to closely fit within opposed ones of said sidewalls, said second insert being provided with at least one third hole having a third size smaller than said first size and different than said second size, said second insert capable of being placed on said permanent tray member such that said third hole is in registry with one of said first holes while said second insert is fit between opposed ones of said sidewalls.

2. The apparatus set forth in claim 1, and further comprising at least two handles affixed to opposed ones of said sidewalls.

3. The apparatus set forth in claim 1, wherein the sidewalls and bottom panel form a cavity, and further wherein said permanent tray member comprises a panel having a plurality of holes therethrough to permit fluid escaped from said fluid vessels to flow into said cavity.

4. The apparatus set forth in claim 1, wherein an absorbent material is disposed adjacent said bottom panel.

5. The apparatus set forth in claim 1, wherein the first insert has a plurality of said second holes, each said second hole located to be in registry with a respective first hole when said first insert is positioned on said permanent tray member.

6. The apparatus set forth in claim 1, wherein the first and second inserts are sized and shaped such that said first and second inserts can be placed side by side on said permanent tray member between opposed ones of said sidewalls.

7. The apparatus of claim 1, wherein said permanent tray member is rectangular and has a width, each of said first and second inserts being rectangular and having a length and a width smaller than said length, the length each of said first and second inserts being substantially the same as said width of said permanent tray member.

8. The apparatus of claim 1, wherein said sidewalls include at least one pair of opposed parallel sidewalls, each of said first and second inserts having opposed parallel margins for registration with said pair of sidewalls, a dimension of each of said first and second inserts between opposed parallel margins thereof being closely received between said pair of sidewalls, such that each of said first and second inserts when correctly positioned will have only one degree of freedom of lateral movement.

9. The apparatus set forth in claim 1 in which said first hole of said permanent tray member is circular.

10. The apparatus of claim 1, wherein said second hole of said first insert is circular.

11. The apparatus of claim 1, and further comprising a plurality of said first inserts which may be selectively used such that at least some of said first holes of the permanent tray member are masked with the first inserts having second holes.

12. The apparatus of claim 11, and further comprising a plurality of said second inserts which may be used in conjunction with said first inserts to mask said first holes of the permanent tray member with first inserts having second holes, and to mask other ones of said first holes with second inserts having third holes.

* * * * *